United States Patent [19]

Hilkene

[11] 4,346,719

[45] Aug. 31, 1982

[54] CIGARETTE EXTINGUISHER

[76] Inventor: John A. Hilkene, 650 Seventh St., Lyndhurst, N.J. 07071

[21] Appl. No.: 259,855

[22] Filed: May 4, 1981

[51] Int. Cl.[3] ..... A24F 19/14

[52] U.S. Cl. ..... 131/236; 131/256

[58] Field of Search ..... 131/236, 256

[56] References Cited

U.S. PATENT DOCUMENTS

| | | | |
|---|---|---|---|
| 563,597 | 7/1896 | Jones | 131/236 X |
| 1,763,678 | 6/1930 | Smith | 131/236 |
| 2,098,337 | 11/1937 | Edwards | 131/256 |
| 3,191,608 | 6/1965 | Licata | 131/256 |

FOREIGN PATENT DOCUMENTS

| | | | |
|---|---|---|---|
| 1414970 | 11/1975 | United Kingdom | 131/236 |

*Primary Examiner*—Stephen C. Pellegrino

*Attorney, Agent, or Firm*—Lerner, David, Littenberg & Samuel

[57] ABSTRACT

An extinguishing device for lighted articles such as cigars, cigarettes and the like. The extinguishing device comprises a housing having a first hollow compartment for containing an extinguishing liquid such as water, and a second hollow compartment containing a capillary material which provides sufficiently small pores throughout to provide by capillary action wetting of the capillary material when extinguishing liquid is introduced into the second compartment, the capillary material being such as to maintain its integrity when wetted with extinguishing liquid. The second compartment has an open end, and the housing is provided with a passageway interconnecting the first compartment with the second compartment to transfer water from the first compartment into the second compartment to wet the capillary material. An extinguishing member of wettable material is also provided for the open end of the second compartment for extinguishing a lighted article which comes in contact therewith. The extinguishing member includes a bottom portion and a side wall portion which extends away from the bottom portion, and is supported in the open end of the second compartment so that (1) the bottom portion is at a lower elevation than the side wall portion; (2) at least the underside of the bottom portion of the extinguishing member is in contact with a first part of the capillary material; and (3) at least a second part of the capillary material is juxtaposed to the side wall portion of the extinguishing member and is at a higher elevation than the bottom portion of the extinguishing member whereby at least the bottom portion of the extinguishing member is continuously wetted by the capillary material when extinguishing liquid is introduced into the second compartment.

12 Claims, 4 Drawing Figures

CIGARETTE EXTINGUISHER

FIELD OF THE INVENTION

The present invention relates to devices for extinguishing articles to be smoked, such as cigars, cigarettes, or the like, and more particularly, to such a device which includes an extinguishing liquid for continuously wetting an extinguishing member for extinguishing a lighted article which comes into contact therewith.

DESCRIPTION OF THE PRIOR ART

As is well known, users of cigars or cigarettes oftentimes attempt to extinguish same by rubbing, pressing or disintegrating the burning end or stub or the cigar or cigarette against a hard surface. However, in many instances, the fire is not completely extinguished, thereby creating a fire hazard, or a source of noxious fumes. Consequently, various prior art devices have been proposed in the past for ensuring more complete and positive extinguishing of the burning or lit end of a cigar or cigarette. For instance, some prior art devices employ a snuffing substance for cutting off the supply of air to the lighted end of the cigar or cigarette. Typical examples of these types of devices are shown in U.S. Pat. Nos. 1,829,844; and 1,964,388 in which loose granular material such as fine sand is provided into which the cigarette end or butt may be placed to cut off the supply of air or oxygen which is necessary to keep the cigarette or cigar lit.

Other types of prior art devices are known which provide a quantity of moisture or liquid for wetting the lit end of the cigar or cigarette. For example, U.S. Pat. No. 1,991,592 shows a cigarette extinguisher which is adapted to apply a drop of water from a reservoir to the lit end of a cigarette to extinguish it, whereas U.S. Pat. No. 1,828,068 discloses the use of a water impregnated sponge as a cigarette extinguisher, and U.S. Pat. No. 2,059,137 discloses a compartmentalized ashtray having several water reservoirs in communication with a wick to impregnate same. Further, other prior art devices such as, for example, those shown in U.S. Pat. No. 2,164,082 and 2,208,072, employ absorbant substances such as deliquescent salts as a cigarette extinguishing means. The concept behind these devices is that the absorbant substance possesses the inherent quality of taking on moisture from the air so as to dissolve gradually and become liquid during the slow absorption of moisture from the air entering the container.

However, these types of prior art devices which contain a liquid such as water have not proven satisfactory in use. For instance, with many of these prior art devices, the reservoir for the liquid is open to air and thus tend to rapidly lose their supply of liquid through evaporation. Thus in turn requires that the reservoir be refilled often, or that relatively large, bulky reservoirs be provided, thereby cutting down on the usefulness and desirability of the devices. Also, such devices tend to dispense large quantities of liquid thereby tending to soak the cigarette or cigar, and thus preventing reuse of same.

Still further, the prior art devices which provide generally closed reservoirs for the extinguishing liquid and which only dispense small quantities of liquid are relatively costly and complex devices which require specialized manufacturing and filling techniques which are both intricate and time consuming in order to provide a device which slowly draws liquid from the reservoir to a location for extinguishing the lit end of a cigarette or cigar.

Consequently, there is a need for relatively simple and economical cigarette extinguishing devices which may be readily used wherever smoking is to take place, and which are not subject to the same deficiencies noted hereinabove with respect to many of the prior art devices.

SUMMARY OF THE INVENTION

The present invention overcomes many of the disadvantages of the prior art by providing an extinguishing device for cigars, cigarettes and the like which is relatively simple in design and operation, and economical to fabricate, but which also is conveniently and readily usable wherever smoking is desired. The device comprises a housing having first and second hollow compartments therein and transfer means for providing fluid communication therebetween. One compartment is adapted to contain a supply of extinguishing liquid, and the second compartment has an open end and contains a capillary material therein which provides sufficiently small pores therethroughout to provide by capillary action wetting of the capillary material when extinguishing liquid is introduced into the second compartment. Also, the capillary material is such as to maintain its integrity when wetted with the extinguishing liquid. An extinguishing member of wetable material is provided for the open end of the second compartment for extinguishing a lighted article which comes into contact therewith. The extinguishing member includes a bottom portion and a side wall portion which extends away from the bottom portion. The extinguishing member is supported in the open end of the second compartment so that (1) the bottom portion is at a lower elevation than the side wall portion; (2) at least the underside of the bottom portion of the extinguishing member is in contact with a first part of the capillary material; and (3) at least a second part of the capillary material is juxaposed to the side wall portion of the extinguishing member and at a higher elevation than the bottom portion of the extinguishing member whereby at least the bottom portion of the extinguishing member is continuously wetted by the capillary material when extinguishing liquid is introduced into the second compartment. Accordingly, when a lit article comes into contact with the bottom portion of the extinguishing member, a small supply of extinguishing liquid is provided on the surface of the extinguishing member to extinguish the lighted end of the article.

More particularly, in this manner at least the bottom portion of the extinguishing member is always wet or moistened with the extinguishing liquid by virtue of the bottom portion being at a lower elevation than the side wall portion and in contact with a first part of the capillary material, and by virtue of at least a second part of the capillary material being at a higher elevation than the bottom portion of the extinguishing member. As the extinguishing liquid is used from the second compartment, it is continuously replenished from the first compartment, irrespective of the height of the extinguishing liquid in the first compartment. This is achieved by virtue of capillary attraction between the liquid and the capillary material in the second compartment. Since the entire capillary material is wetted (i.e., that portion which is above and below the elevation of the part in contact with the bottom part of the extinguishing member), at least the bottom portion of the extinguishing member in contact with the capillary material is also wetted, even if the liquid evaporates from the upper end of the capillary material.

In the preferred embodiment, the extinguishing member comprises a wire screen of a generally concave configuration which is supported in the upper open end of the second compartment. The open nature of the wire screen allows water in the second compartment to freely pass therethrough so that at least the bottom portion is continuously wetted. This is true even if the capillary material should tend to compact slightly during use at its upper end since at least the bottom portion remains in contact with the capillary material. Also, the effect of whatever evaporation of extinguishing liquid which takes place occurs at the upper end of the capillary material which is at an elevation above the bottom portion of the screen, and consequently, at least the bottom portion of the screen remains wetted. Here, it should be noted that as the extinguishing liquid tends to evaporate, the liquid is continuously supplied to the pores at the upper elevation of the capillary material in the second compartment, thereby ensuring that at least the second part of the capillary material in contact with the screen remains moist for the purposes of wetting the bottom portion of the screen.

In the preferred embodiment, the capillary material may advantageously comprise a heat expanded silicate material, such as for example perlite, which creates relatively small pores having high surface area for a given volume of material. Such a material also maintains its integrity when wetted, and in particular does not dissolve when wetted with the extinguishing liquid. This is important in order that it not be necessary to continuously replenish the supply of capillary material during use of the extinguishing device.

These and further features and characteristics of the present invention will be apparent from the following detailed description in which reference is made to the enclosed drawings which illustrate a preferred embodiment of the present invention.

DETAILED DESCRIPTION OF THE PREFERRED EMBODIMENT

Figure 1:
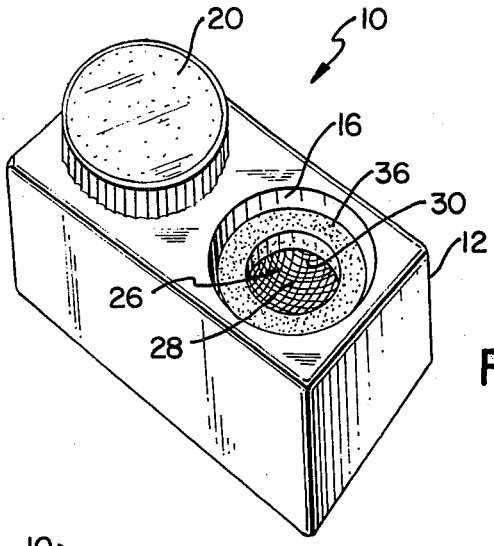
FIG. 1 is a perspective view of the extinguishing device in accordance with the present invention.
Figure 2:
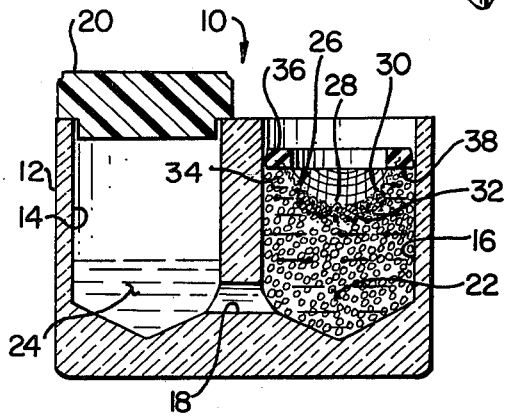
FIG. 2 is a side sectional view of the extinguishing device of the present invention illustrating a first hollow compartment containing an extinguishing liquid such as water, and a second hollow compartment containing capillary material, the upper end of the second compartment being provided with an extinguishing member which is wetted by the wetted capillary material.

Referring now to the drawings wherein like reference characters represent like elements, there is shown in FIG. 1 an extinguishing device 10 in accordance with the present invention for extinguishing lighted articles such as cigars, cigarettes and the like. The extinguishing device 10 generally comprises a housing 12 having at least two hollow compartments or vessels 14, 16 therein which are interconnected by means of a fluid transfer bore 18 provided adjacent the bottom, closed ends of each of the compartments 14, 16 (see FIG. 2). The first compartment 14 is for the purposes of containing an extinguishing liquid 24, such as water which is readily available and economical. The extinguishing liquid may be introduced into the first compartment 14 through the open, upper end thereof. As shown in FIGS. 1 and 2, the upper end of the first compartment may be closed with a suitable cap member 20 for inhibiting evaporation and loss of water therefrom.

The second compartment 16 contains a suitable supply of capillary material 22 which, when placed in the second compartment 16, provides sufficiently small pores therethroughout to provide by capillary action wetting of the capillary material 22 when liquid 24 is introduced into the second compartment 16 through the bore 18. In this regard, capillary action refers generally to the phenomena by which the surface of a liquid which is in contact with a solid is elevated (or in some instances depressed) depending upon the relative attraction of the molecules of the liquid for each other and for those of the solid. More particularly, as is well known, when there is large adhesion between a liquid in contact with a solid, the level of the liquid along the solid tends to elevate. Thus, when the solid is provided in an open tube or chamber which communicates with a supply of liquid in another open chamber that does not have the solid therein, the level of the liquid in the tube or chamber having the solid therein will be at a higher elevation. The particular characteristics respecting the height of the liquid are dependent on achieving an equilibrium of the forces acting at the interface of the solid, the liquid and the gas in which the liquid and solid are present. As is also known, such large adhesion forces may be provided by a solid having a relatively large surface area for a given volume of the solid, such as when the solid contains a large number of very small pores therethroughout or creates small pores by virtue of very small or fine particulate matter being compacted in a chamber.

In terms of the extinguishing device 10 of the present invention, the capillary material 22 in the second hollow compartment 16 is such as to provide a relatively large surface area for a given volume or quantity of material 22 in order to provide by capillary action wetting of the capillary material 22 with the liquid 24 from the first compartment 14 which is introduced into the second compartment 16 through the bore 18, irrespective of the level of liquid 24 in the first compartment 14. This is most important for ensuring that the capillary material 22 remains continuously wetted even as the level of the liquid 24 in the first compartment drops to an elevation below the upper end of the capillary material 22 in the second compartment 16 during usage of the extinguishing device 10.

The second compartment 16 has an open end for receipt of an extinguishing member 26 which will serve to extinguish lighted articles which come into contact therewith. The extinguishing member 26 includes a bottom portion 28 and a side wall portion 30 which extends upwardly away from the bottom portion 28. The extinguishing member 26 is adapted to be supported in the open end of the second compartment 16 so that the bottom portion 28 is placed at a lower elevation than the side wall portion 30 and so that at least the underside of the bottom portion 28 is in contact with first part 32 of the capillary material 22 in the second compartment. Also, at least a second part 34 of the capillary material 22 is juxtaposed to the side wall portion 30 of the extinguishing member 26 so as to be at a higher elevation than the bottom portion 28. In particular, in the preferred embodiment, the second part 34 of the capillary material 22 surrounds and is in contact with the side wall portion 30 of the extinguishing member 26.

Figure 3:
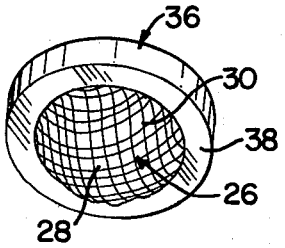
FIG. 3 is a bottom perspective view of one form of an extinguishing member in accordance with the present invention.
Figure 4:
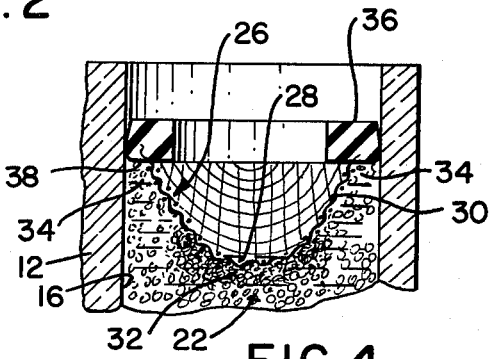
FIG. 4 is an enlarged side elevational view of the upper end of the second compartment of the extinguishing device, illustrating in greater detail the extinguishing screen member in contact with the capillary material therein so that at least the bottom portion of the screen member is continuously wetted by the wetted capillary material.

The extinguishing member 26 preferably comprises a wire screen element having a generally concave configuration, as can best be seen in FIGS. 2, 3 and 4. The concave screen element 26 is supported by a ring element 36 so as to extend downwardly therefrom. The ring element 36 has an opening in the central portion thereof to provide access to the lower or bottom portion 28 of the screen element 26. The ring 36 and wire screen 26 are placed in the open end of the second compartment 16 so that the screen element 26 is in contact with the upper surface of the capillary material 22. In this regard, the ring member 36 is sized to fit within the upper end of the second compartment 16 and then be pushed downwardly so that the underside of the screen element 26 is placed in contact with the capillary material 22. Preferably, the entire undersurface of the screen element 26 contacts the capillary material 22, although as will be more fully discussed hereinbelow, the capillary material 22 adjacent the upper edges of the screen element 26 need not necessarily contact the screen element 26. Because the liquid in the capillary material 22 rises to a suitable elevation to wet the entire capillary material 22 and since virtually the entire screen element 26, and at least the bottom portion thereof, will be in contact with the wetted capillary material 22, it will be appreciated that the screen element 26 will thus be wetted by the capillary material 22 to provide a small quantity of liquid on the upper surface of the screen element 26 for the purposes of extinguishing a lighted article which comes into contact therewith.

In this regard, as evaporation naturally occurs as a result of exposure to the atmosphere, there may be a slight tendency for the upper edges of the screen element 26 to dry. Also, there may be a slight compaction of the capillary material 22 during usage such that the capillary material 22 is not in contact with the upper side edges of the wire screen element 26, thereby allowing the upper edges of the screen element 26 to become dry. However, this does not adversely affect the wetting of the bottom portion 28 of the screen element 26 since the effect of evaporation will substantially occur only at the upper end or elevation of the capillary material 22 while the part 32 of the capillary material 22 in contact with the bottom portion 28 of the screen elemen 26 remains wet. While not meant to be bound as to the reason for this phenomena, it is believed to result from the fact that the liquid level in the upper annular part 34 of the capillary material 22 is at a higher elevation than the part 32 in contact with the bottom portion 28 of the screen element 26. In other words, although liquid tends to evaporate at a liquid-air interface, the lower elevation part 32 in contact with the bottom portion 28 of the screen element 26 is immediately replenished by the liquid in the upper part 34 of the capillary material 22 which is not along the liquid-air interface. In this regard, while the liquid is continuously replenished in both the upper elevation portion 34 and the lower elevation portion 32, the effect of evaporation is only experienced at the upper portion 34 of the air-liquid interface, i.e., at the upper side edges of the screen element 26. In any event, while a short time may be necessary to increase the level of the liquid to wet the upper part 34 of the capillary material 22, the liquid level is continuously maintained above the elevation of the bottom portion 28 of the extinguishing member 10 which thus remains wetted.

Here it should be noted that if a substantially flat screen were provided in contact with the capillary material 22, evaporation would occur on a continuous basis across the entire surface of the screen and thus tend to dry out. Also, the capillary material 22 may tend to compact slightly and thus withdraw from contact with the surface of the screen. This would adversely affect wetting of the screen element such that the screen may not always be wet. On the other hand, by virtue of having a bottom portion 28 of the screen element 26 which is at a lower elevation than the side wall portion 30. The bottom portion 28 is in contact with the capillary material 22 and the effects of evaporation occur at the upper end of the side wall 30 of the screen element 26. Further, the effects of compacting of the capillary material 22 which causes withdrawal or separation from the screen element 26 are only experienced at the upper end of the screen element 26, and not at the lower bottom portion 28. Accordingly, with the present invention, at least the bottom portion 28 of the screen element 26 remains in contact with the wetted capillary material 22, and thus remains moist for the purposes of extinguishing a cigarette, a cigar or the like.

The housing 12 of the extinguishing device 10 may be made of any suitable material such as wood, glass, ceramic, plastic, metal, or the like. In the preferred embodiment, the housing 12 is made of a plastic material which is preferably translucent or transparent. The hollow compartments 14, 16 may conveniently comprise a pair of bores in the housing 12. The bores 14, 16 and the interconnecting bore 18 may be formed by means of conventional fabricating techniques such as extrusion, ejection molding, and the like, or by mechanical boring, reaming or perforating means being applied to solid items of desired material and size. The size of the compartments 14, 16 in the housing 12 may be chosen as desired so as to control the amount of water or other extinguishing liquid 24 introduced into the first hollow compartment 14 and subsequently transferred to the second hollow compartment 16.

Similarly, the ring member 36 and screen element 26 may be made of any suitable materials. In the preferred embodiment, the ring member 36 comprises a rubber or plastic ring member to which the concave wire screen member 26, is heat sealed or bonded to the underside thereof, as can best be seen in FIG. 3. The lower surface 38 of the ring member 36 provides a convenient means for supporting the wire screen element 26 on the capillary material 22 so as to ensure that the screen member 26 is in contact with the capillary material 22. Specifically, the ring member 36 and screen element 26 are suitably placed in the open end of the second compartment 16 and pushed downwardly so that the lower surface 38 of the ring member 36 engages the upper edge of the capillary material 22 with the screen element 26 serving to compact the capillary material 22 to assume a generally concave configuration at the upper surface, as best seen in FIGS. 2 and 4. In this manner, the bottom portion 28 of the screen element 26 is placed in surface contact with the capillary material 22. The size of the pores or openings through the screen element 26 are preferably chosen in relation to the capillary material 22 so that the capillary material 22 is generally maintained beneath the screen element 26 as opposed to passing through the screen element 26, while also allowing the extinguishing liquid to pass freely therethrough to ensure that at least the bottom portion 28 of the screen is continuously wetted.

As noted hereinabove, the capillary material 22 is preferably designed to provide sufficiently small pores therethroughout to provide for the desired capillary action when liquid 24 from the first compartment 14 is introduced into the second compartment 16 to thereby wet the entire capillary material 22, the elevation of the liquid which is achieved being such as to ensure that the entire material 22 is wetted. While many types of materials could be utilized for the capillary material, it is preferable that the capillary material comprise particulate matter which has or provides a sufficiently high surface area in relation to the volume of the matter to create the desired capillary action. For example, such particulate material may comprise suitable heat expanded silicate materials, such as for example perlite or pumice, as such materials have sufficiently small pores therethroughout, and thus a relatively high surface area for a given volume of material, to provide for the desired capillary action. Also, very fine sand could likewise be utilized. In this regard, it is to be noted that it is preferable that the integrity of the capillary material 22 be maintained when wetted so that it is not necessary to periodically replace or replenish the supply of capillary material 22 in the extinguishing device 10. Other examples of materials which could be utilized and which would provide the desired capillary action and desired maintenance of integrity when wetted include various types of alumina materials, and diatomaceous earth materials.

Further, it will be noted that since the surface area of the screen element 26 is relatively small, particularly the bottom portion 28 thereof, large quantities of liquid will not necessarily be dispensed in a single extinguishing operation; rather, only a small quantity of liquid will be provided for wetting of the surface of the screen element 26 for an extinguishing operation. This is advantageous since it will not serve to rapidly deplete the water supply in the first compartment 14 as typically occurs in many of the prior art devices.

The extinguishing member 26 in the preferred embodiment is also advantageous in that it collects ashes from the lighted cigarettes and cigars, and thus prevents them from mingling with the capillary material 22. In this regard, the ashes are collected on the upper side of the screen element 26. After several uses, the ashes which have accumulated in the screen element 26 may be dumped in the trash, and the screen element 26 quickly and easily cleaned by running the screen element 26 under water.

The extinguishing device 10 in accordance with the present invention thus provides a very compact, economical unit which readily functions to extinguish lighted cigarettes, cigars and the like, which come into contact with the extinguishing member 26 and which dispenses only small quantities of extinguishing liquid 24 during a single extinguishing operation. The extinguishing liquid which is utilized in the extinguishing operation is quickly replenished in the second compartment 16 to moisten the screen element 26 for a second and subsequent extinguishing operations by virtue of the capillary action provided by the capillary material 22 in the second compartment 16. Because of the small, compact size of the housing 12, the extinguishing device 10 can be readily used and available for use wherever smoking takes place, for example, in automobiles, at the office, at home, etc. Still further, because of its compact size, the extinguishing device may be readily placed in an ashtray for use in conjunction therewith. Futhermore, such an extinguishing device 10 is relatively simple in design and operation, and is economical to produce as it only requires readily available materials and no highly specialized manufacturing or fabricating techniques.

Accordingly, there is provided in accordance with the present invention an extinguishing device 10 which comprises a housing 12 having first and second compartments 14, 16 therein, the first compartment 14 being adapted to contain a supply of extinguishing liquid 24 and the second compartment 16 containing a supply of capillary material 22 which provides sufficiently small pores therethroughout to provide by capillary action wetting of the capillary material 22 when the liquid is introduced into the compartment 16. The capillary material 22 is such as to maintain its integrity when wetted with the extinguishing liquid. An extinguishing member 22 which includes a bottom portion 28 and side wall portion 30 is supported in the open end of the second compartment 16 so that the bottom portion 28 is located at a lower elevation than the side wall portion 30 and so that at least the underside of the bottom portion 28 of the extinguishing member 26 is in contact with a first part 32 of the capillary material 22. A second part 34 of the capillary material 22 is juxtaposed to the side wall portion 30 so as to be at a higher elevation than the bottom portion 28 to thereby ensure that at least the bottom portion 28 of the extinguishing member 26 is continuously wetted by the capillary material 22 when extinguishing liquid is introduced into the second compartment 16.

While the preferred embodiment of the present invention has been shown and described, it will be understood that such is merely illustrative and that changes may be made without departing from the scope of the invention as claimed.

What is claimed is:

1. An extinguishing device for cigars, cigarettes, and the like, comprising:

a housing having a first hollow compartment therein for containing an extinguishing liquid, and a second hollow compartment therein containing a capillary material which provides sufficiently small pores therethroughout to provide by capillary action wetting of the capillary material when extinguishing liquid is introduced into said second compartment, said capillary material being such as to maintain its integrity when wetted with extinguishing liquid, and at least said second compartment having an open end;

transfer means for transferrng extinguishing liquid from said first compartment of said housing to said second compartment of said housing to thereby wet said capillary material in said second compartment;

an extinguishing member of wetable material for said open end of said second compartment for extinguishing a lighted article which comes into contact therewith, said extinguishing member including a bottom portion and a side wall portion which extends away from said bottom portion, said extinguishing member being supported in said open end of said second compartment so that (1) said bottom portion is at a lower elevation than said side wall portion; (2) at least the underside of said bottom portion of said extinguishing member is in contact with a first part of said capillary material; and (3) at least a second part of said capillary material is in juxtaposition with said side wall portion of said extinguishing member and at a higher elevation than said bottom portion of said extinguishing member, whereby at least said bottom portion of said extinguishing member is continuously wetted by said capillary material when extinguishing liquid is introduced into said second compartment.

2. The extinguishing device of claim 1 wherein said extinguishing member comprises a wire screen element having a bottom portion and a side wall portion extending away from said bottom portion.

3. The extinguishing device of claim 2 wherein said wire screen element has a concave configuration.

4. The extinguishing device of claim 3 further including a support ring for said wire screen element, the upper edge of said side wall portion of said wire screen element being secured to said ring member, and said ring member being arranged with respect to said open end of said second compartment so as to support said screen element in said open end of said second compartment.

5. The extinguishing device of claim 1 wherein said capillary material comprises a particulate matter providing a sufficiently large surface to volume ratio so as to provide by capillary action wetting of said particulate matter when extinguishing liquid is introduced into said second compartment.

6. The extinguishing device of claim 5 wherein said particulate matter is selected from the group consisting of silicate particulate material, alumina particulate material, and diatomaceous earth particulate material.

7. The extinguishing device of claim 6 wherein said particulate matter comprises a heat expanded silicate particulate material.

8. The extinguishing device of claim 7 wherein said heat expanded silicate particulate material comprises perlite.

9. The extinguishing device of claim 5 wherein said extinguishing member comprises a wire screen element having openings therethrough of a size which is smaller than the size of said particulate matter so that said particulate matter will not pass through said openings of said screen element.

10. The extinguishing device of claim 1 wherein said first and second hollow compartments in said housing comprise first and second bores in said housing, said first and second bores being spaced from one another in said housing, and wherein said transfer means comprises a fluid passageway interconnecting said first and second bores.

11. The extinguishing device of claim 10 wherein said first bore has an open end and a closed end, wherein said second bore also has a closed end, and wherein said fluid passageway interconnects said first and second bores adjacent said closed ends thereof.

12. The extinguishing device of claim 1 further including a cap member for said open end of said first bore.

* * * * *